US009936748B1

(12) United States Patent
Pinto

(10) Patent No.: US 9,936,748 B1
(45) Date of Patent: Apr. 10, 2018

(54) SCARF HOLDER AND ASSOCIATED USE THEREOF

(71) Applicant: Ana Pinto, Dayton, NJ (US)

(72) Inventor: Ana Pinto, Dayton, NJ (US)

( * ) Notice: Subject to any disclaimer, the term of this patent is extended or adjusted under 35 U.S.C. 154(b) by 80 days.

(21) Appl. No.: 15/040,964

(22) Filed: Feb. 10, 2016

Related U.S. Application Data

(60) Provisional application No. 62/114,108, filed on Feb. 10, 2015.

(51) Int. Cl.
*A42B 5/00* (2006.01)
*A41D 23/00* (2006.01)
*A41D 27/08* (2006.01)

(52) U.S. Cl.
CPC ..... *A41D 23/00* (2013.01); *A41D 27/08* (2013.01)

(58) Field of Classification Search
CPC ..... A41D 23/00
See application file for complete search history.

(56) References Cited

U.S. PATENT DOCUMENTS 3,088,119 A * 5/1963 Grant ..... A41D 23/00 2/130
3,748,661 A * 7/1973 Smith ..... A42B 5/00 2/144
5,867,835 A * 2/1999 Dabbieri ..... A42C 5/00 2/171

FOREIGN PATENT DOCUMENTS

JP 2012125267 A * 7/2012

* cited by examiner

*Primary Examiner* — Tejash Patel
(74) *Attorney, Agent, or Firm* — Ashkan Najafi

(57) ABSTRACT

A combined scarf and scarf holder includes a flexible scarf, and a scarf holder removably engaged with a portion of the scarf such that the scarf is maintained at a substantially stable position while permitting the scarf to be removably positioned through the scarf holder. Such a scarf holder includes a curvilinear body having a first end and a second end, a first fastener attached to the first end, and a second fastener attached to the second end. In this manner, the first fastener is detachably mated to the second fastener such that the body is selectively adapted between an open position and a closed position.

17 Claims, 6 Drawing Sheets

SCARF HOLDER AND ASSOCIATED USE THEREOF

CROSS REFERENCE TO RELATED APPLICATIONS

This is a non-provisional patent application that claims the benefit of U.S. provisional patent application No. 62/114,108 filed Feb. 10, 2015, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

Technical Field

Exemplary embodiment(s) of the present disclosure relate to scarf holders and, more particularly, to a fashionable security clip specially designed for keeping a scarf in place around a user's neck.

Prior Art

As the cool, brisk days of autumn give way to the snowy, freezing months of the winter season, Americans who reside in colder climates begin to pull their cold weather wear from the backs of closets and from little used drawers. Down jackets and fleece coats, padded gloves and toboggans, and earmuffs and snow boots are some of the clothing items employed to keep warm while going about daily activities when winter arrives.

Another cold weather accessory that is ubiquitous during the winter months is the scarf. A long piece of cloth worn about the head, neck, or shoulders, the scarf serves as an added means of ensuring these areas remain toasty while outdoors. While a convenient source of warmth when winds are blustery, scarves can also feature a couple of drawbacks. Particularly, the loose nature of these garments sometimes cannot stand up to gusts of winter wind, whipping around the wearer in a frustrating and annoying manner. To better secure a scarf around the neck, users typically wind the elongated unit around into layers, tucking the end into the coat to keep it in place. However, this practice tends to result in a bulky and cumbersome accessory, leaving the wearer quite uncomfortable.

Accordingly, a need remains for a scarf holder in order to overcome at least one shortcoming. The exemplary embodiment(s) satisfy such a need by providing a fashionable security clip that is convenient and easy to use, lightweight yet durable in design, versatile in its applications, and designed for keeping a scarf in place around a user's neck.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a combined scarf and scarf holder for keeping the scarf in place around a user neck. These and other objects, features, and advantages of the non-limiting exemplary embodiment(s) are provided by a combined scarf and scarf holder including a flexible scarf, and a scarf holder removably engaged with a portion of the scarf such that the scarf is maintained at a substantially stable position while permitting the scarf to be removably positioned through the scarf holder. Such a scarf holder includes a curvilinear body having a first end and a second end, a first fastener attached to the first end, and a second fastener attached to the second end. In this manner, the first fastener is detachably mated to the second fastener such that the body is selectively adapted between an open position and a closed position.

In a non-limiting exemplary embodiment, the body includes a plurality of arcuate members configured in a stacked orientation. Each of the arcuate members is substantially coextensively shaped relative to each other. Advantageously, each of the arcuate members includes at least one longitudinal edge directly mated to a conjoining longitudinal edge of an arcuate member.

In a non-limiting exemplary embodiment, each of the arcuate members has an identical radius of curvature such that the arcuate members are uniformly and contemporaneously flexed between equilibrium and tensioned positions, respectively.

In a non-limiting exemplary embodiment, each of the arcuate members has a fixed and substantially coextensive longitudinal length relative to each other.

In a non-limiting exemplary embodiment, the first fastener is coextensively shaped as the second fastener.

In a non-limiting exemplary embodiment, the first fastener is directly coupled to the second fastener when the body is at the closed position.

In a non-limiting exemplary embodiment, the first fastener includes a magnet situated therein.

In a non-limiting exemplary embodiment, each of the arcuate members entirely consists of leather.

In a non-limiting exemplary embodiment, each of the arcuate members entirely consists of mesh metal.

The present disclosure also includes a method of utilizing a combined scarf and scarf holder for keeping the scarf in place around a user neck. Such a method includes the steps of: providing a flexible scarf; and providing a scarf holder including a curvilinear body having a first end and a second end, a first fastener attached to the first end, and a second fastener attached to the second end.

The method further includes the steps of: removably engaging the scarf holder with a portion of the scarf, by removably positioning the scarf through the scarf holder, such that the scarf is maintained at a substantially stable position while positioned through the scarf holder; and selectively adapting the body between an open position and a closed position by detachably mating the first fastener to the second fastener.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
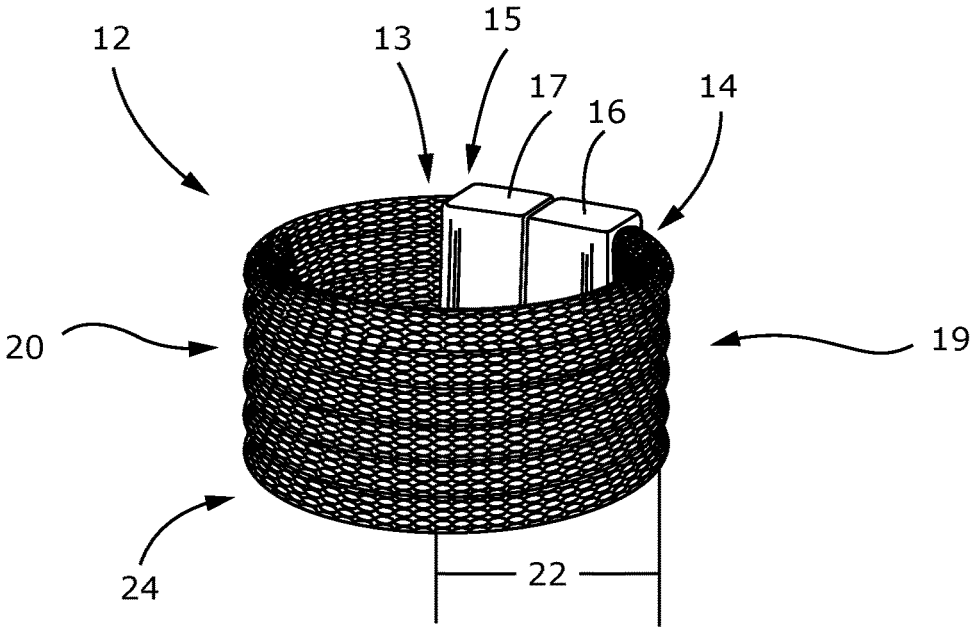
FIG. 1 is a perspective view showing a rear side of a scarf holder at a closed position, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-6 and is/are intended to provide a combined scarf and scarf holder (collectively at 10) for keeping the scarf 11 in place around a user neck. The combined scarf and scarf holder (collectively at 10) includes a flexible scarf 11, and a scarf holder 12 removably engaged with a portion of the scarf 11 such that the scarf 11 is maintained at a substantially stable position while permitting the scarf 11 to be removably positioned through the scarf holder 12. Such a scarf holder 12 includes a curvilinear body 13 having a first end 14 and a second end 15, a first fastener 16 attached to the first end 14, and a second fastener 17 attached to the second end 15. In this manner, the first fastener 16 is detachably mated to the second fastener 17 such that the body 13 is selectively adapted between an open position 18 and a closed position 19.

In a non-limiting exemplary embodiment, the body 13 includes a plurality of arcuate members 20 configured in a stacked orientation—as shown throughout FIGS. 1-6. Each of the arcuate members 20 is substantially coextensively shaped relative to each other. Advantageously, each of the arcuate members 20 includes at least one longitudinal edge 21 directly mated to a conjoining longitudinal edge 21*a* of another arcuate member 20.

Figure 7:
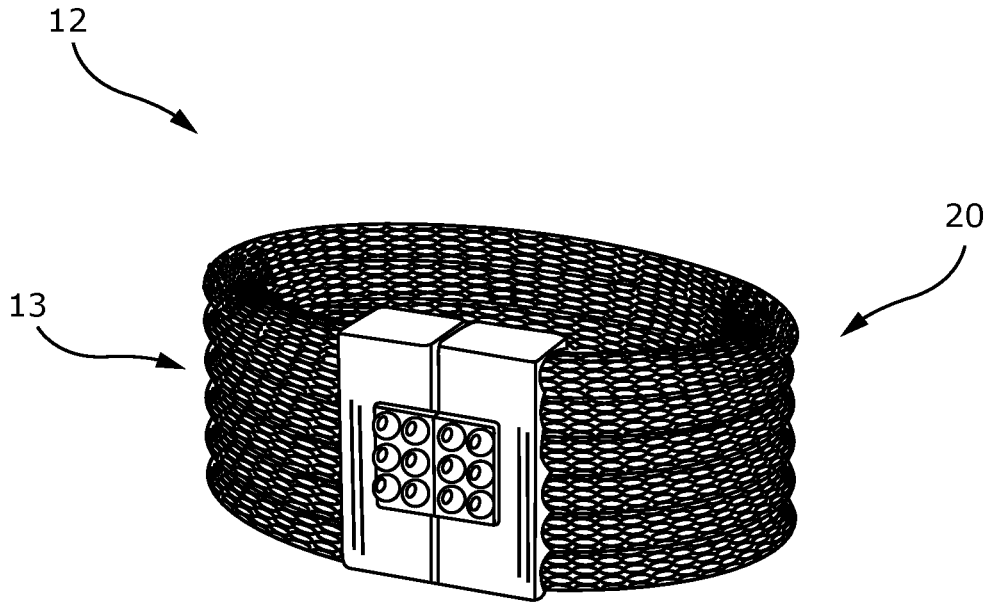
FIG. 7 is a perspective view showing the scarf holder, illustrated in FIG. 2, at a stretched, closed position.
Figure 8:
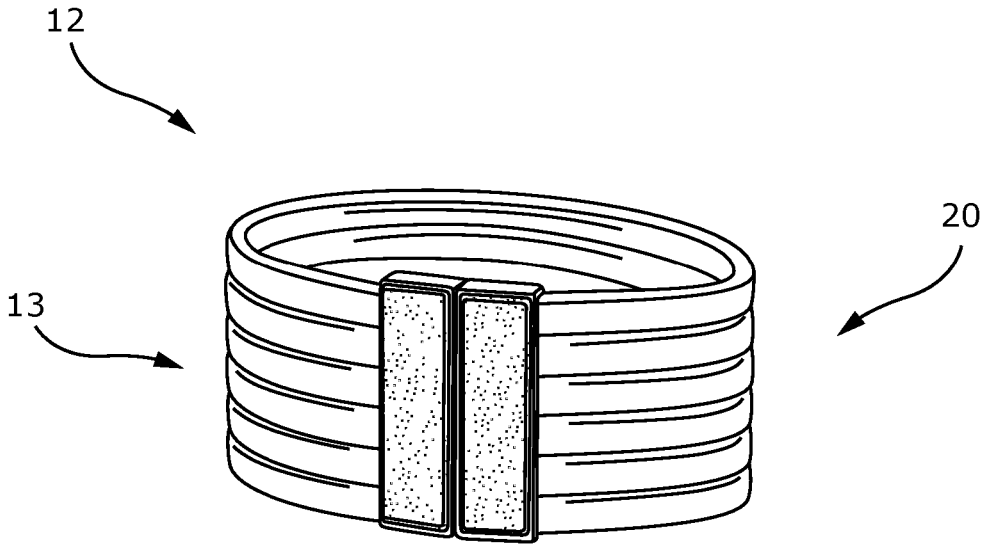
FIG. 8 is a perspective view showing the scarf holder, illustrated in FIG. 4, at a stretched, closed position.

In a non-limiting exemplary embodiment, each of the arcuate members 20 has an identical radius of curvature 22 such that the arcuate members 20 are uniformly and contemporaneously flexed between equilibrium and tensioned positions (open and closed positions 18, 19), respectively. In other words, because the arcuate members 20 are statically affixed to each other, each arcuate member 20 expands and contracts in sync with each other. FIGS. 7 and 8 shows the arcuate members 20 at an exemplary tensioned position wherein the body 13 is stretched, for example.

In a non-limiting exemplary embodiment, each of the arcuate members 20 has a fixed and substantially coextensive longitudinal length 24 relative to each other. The longitudinal lengths 24 of each arcuate member 20 are measure along the curvilinear lengths thereof, respectively.

In a non-limiting exemplary embodiment, the first fastener 16 is coextensively shaped as the second fastener 17. Thus, when the body 13 is at a closed position 19, the scarf holder 12 has a substantially uniform shape.

In a non-limiting exemplary embodiment, the first fastener 16 is directly coupled to the second fastener 17 when the body 13 is at the closed position 19.

Figure 6:
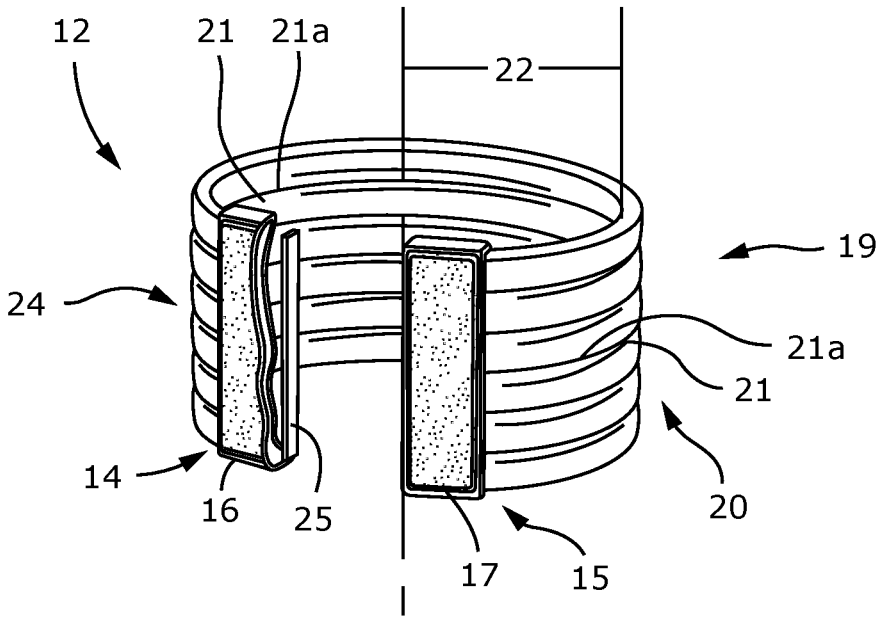
FIG. 6 is a break-away view showing a magnet located inside a magnet closure of the scarf holder illustrated in FIG. 4.

In a non-limiting exemplary embodiment, as perhaps best shown in FIG. 6, the first fastener 16 includes a magnet 25 situated therein. It is noted that the second fastener 17 may also have a magnet with an opposed charge located therein. Alternately, only one magnet 25 may be employed and the outer surface of second fastener 17 may include magnetic properties In a non-limiting exemplary embodiment, as perhaps best shown in FIGS. 3-6, each of the arcuate members 20 entirely consists of leather 26.

In non-limiting exemplary embodiments, a branded logo (e.g., emblem) may be affixed to an exterior surface of the first fastener 16 and the second fastener 17.

In a non-limiting exemplary embodiment, a branded logo (e.g., emblem) may be affixed directly onto the arcuate members 20 of the body 13.

In a non-limiting exemplary embodiment, the arcuate members 20 may be approximately eight inches long and slender so that it can be easily wrapped about the scarf 11.

In a non-limiting exemplary embodiment, each of the arcuate members 20 entirely consists of braded leather.

In a non-limiting exemplary embodiment, each of the arcuate members 20 entirely consists of leather straps.

In a non-limiting exemplary embodiment, the body 13 may be formed of a single and unitary piece of leather.

Figure 2:
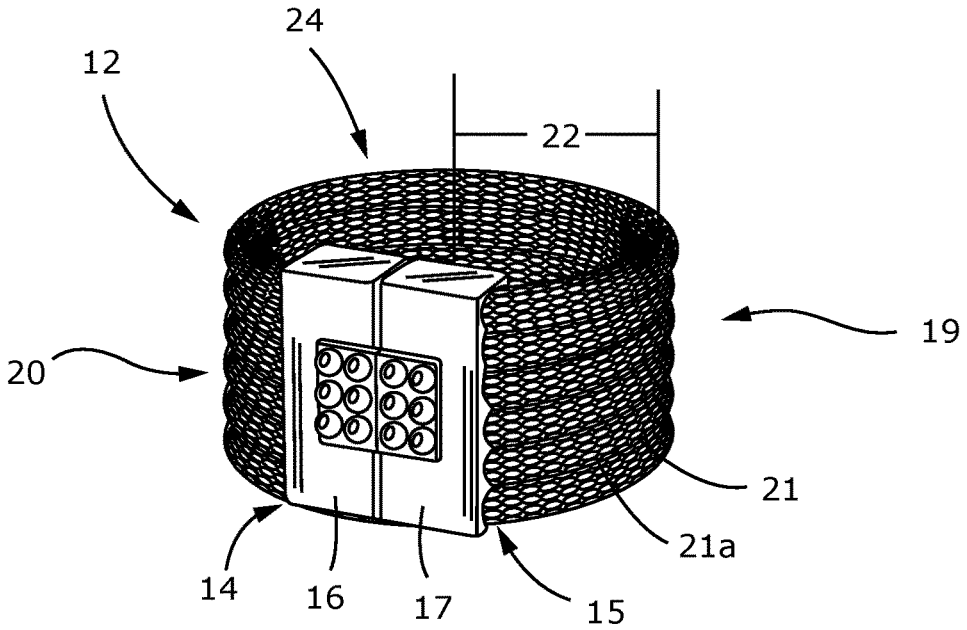
FIG. 2 is a perspective view showing a front side of the scarf holder illustrated in FIG. 1.
Figure 3:
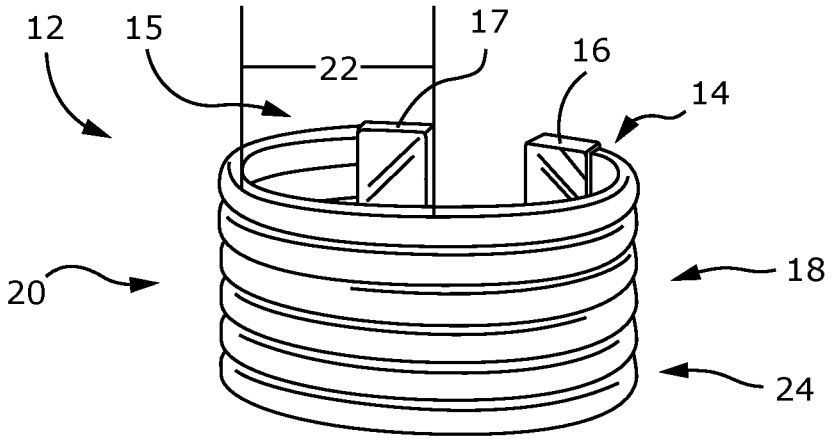
FIG. 3 is a perspective view showing a rear side of a scarf holder at an open position, in accordance with another non-limiting exemplary embodiment.
Figure 4:
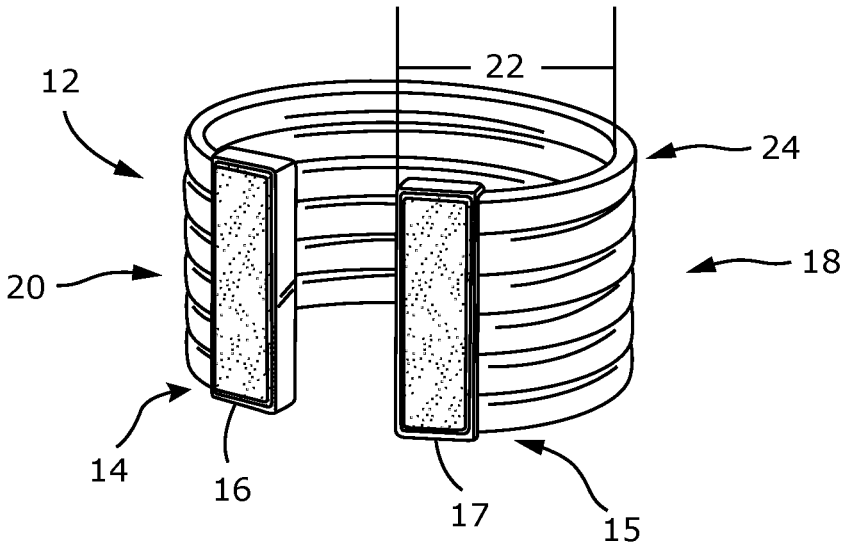
FIG. 4 is a perspective view showing a front side of the scarf holder illustrated in FIG. 3.
Figure 5:
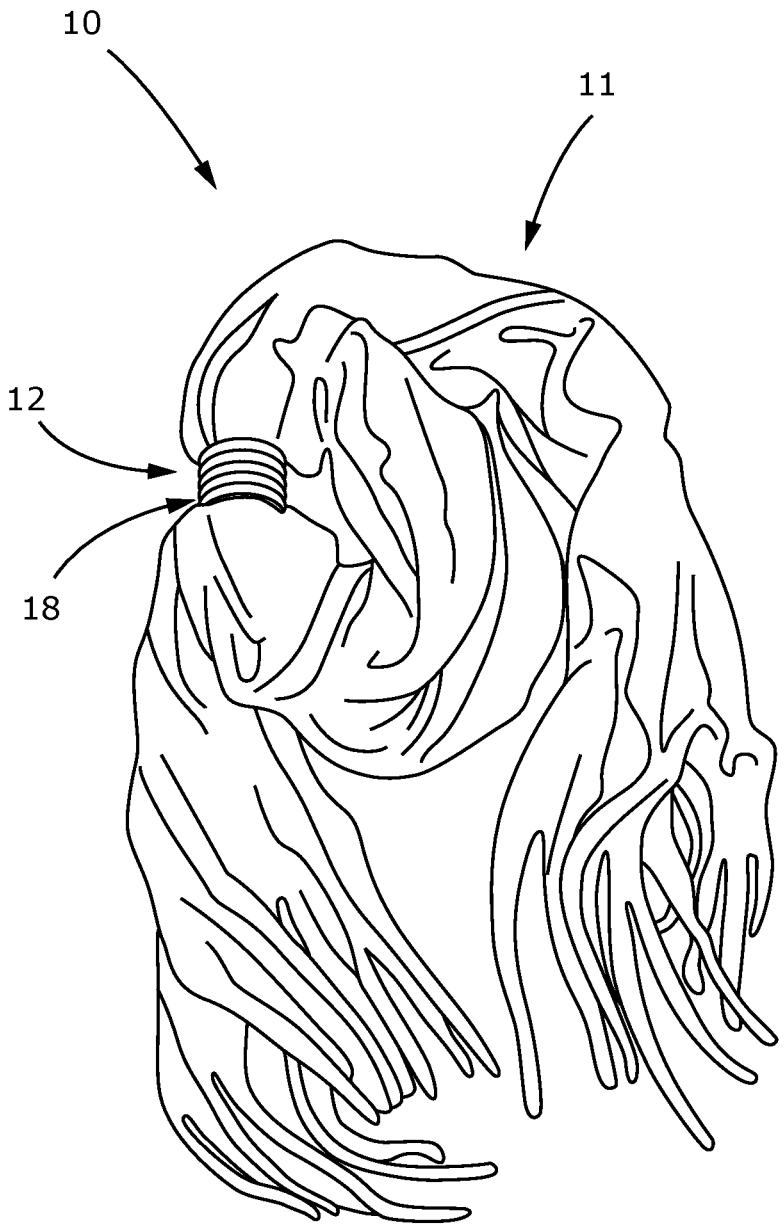
FIG. 5 is a perspective view showing a combined scarf and scarf holder wrapper thereabout.

In a non-limiting exemplary embodiment, as perhaps best shown in FIGS. 1-2, each of the arcuate members 20 entirely consists of mesh metal 28.

The present disclosure also includes a method of utilizing a combined scarf and scarf holder (collectively at 10) for keeping the scarf 11 in place around a user neck. Such a method includes the steps of: providing a flexible scarf 11; and providing a scarf holder 12 including a curvilinear body 13 having a first end 14 and a second end 15, a first fastener 16 attached to the first end 14, and a second fastener 17 attached to the second end 15.

The method further includes the steps of: removably engaging the scarf holder 12 with a portion of the scarf 11, by removably positioning the scarf 11 through the scarf holder 12, such that the scarf 11 is maintained at a substantially stable position while positioned through the scarf holder 12; and selectively adapting the body 13 between an open position 18 and a closed position 19 by detachably mating the first fastener 16 to the second fastener 17.

Non-limiting exemplary embodiments of the present disclosure are referred to generally in the figures and are intended to provide a fashionable security clip (scarf holder 12) specially designed for keeping a scarf 11 in place around a user's neck. It should be understood that the exemplary embodiment(s) may be used to hold a variety of scarfs 11, and should not be limited to any particular scarf 11 described herein.

Referring to FIGS. 1-6 in general, in a non-limiting exemplary embodiment(s), the scarf holder 12 may be embodied as a fashionable security clip that is specially designed to keep a scarf 11 firmly and comfortably around the user neck, while also facilitating creative scarf 11 positioning for a variety of looks. Presented in a circular ring-like shape—when at a closed position 19—this product is fashioned from durable materials such as plastic, metal 28, or leather 26. As a non-limiting example, compact and non-cumbersome, each unit may measure approximately four and three-quarter inches (4¾") in length and one inch (1") in width.

Yet, perhaps the most useful and exciting feature of the scarf holder 12 is found in its security mechanism. When the body 13 is opened, each end 14, 15 may boast a handy magnetic 25 clip closure (fasteners 16, 17). As such, one need only pass a scarf 11 through the body 13 passageway in the desired fashion. Closing the scarf holder 12 over the overlapping sections of the scarf 11, the user snaps the scarf holder 12 closed, steadfastly securing the scarf 11 together, and in place. The scarf holder 12 may be offered in a wide variety of colors, styles, and designs to appeal to any user or to match a chosen ensemble.

There are several significant benefits and advantages associated with this clever product. For example, the scarf holder 12 provides consumers with a more user-friendly accessory for helping keep the neck warm during the winter months. A compact, magnetically enhanced clip that wraps around the material of a scarf 11, this practical product eliminates the frustrations often associated with wearing scarfs 11 on particularly blustery days. As a result, more users are encouraged to bundle up against the cold with a toasty scarf 11, as the scarf holder 12 keeps the scarf 11 from flying willy-nilly, alleviating constant and annoying adjustment. Offered in a wide variety of colors, styles, and designs, there is sure to be a scarf holder 12 to perfectly compliment any wintertime ensemble.

While this product certainly is appreciated by female users as an eye-catching enhancement to any scarf 11, men would also enjoy the practicality of securing their scarfs 11 against the biting winds of cold climates. Gorgeously rendered, scarf holder 12 makes a perfect holiday gift, particularly when accompanied with a fashionable scarf 11 artfully displayed in a festive gift box. Made of durable, high quality materials, the scarf holder 12 will withstand many winters of continued use.

The scarf holder 12 is an innovative product which effectively alleviates the challenges already faced when dressing to protect the user from wintry chill. Accommodating any style or size of scarf 11, this practical product could be enjoyed by children as well as adults.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A combined scarf and scarf holder for keeping said scarf in place around a user neck, said combined scarf and scarf holder comprising:

a scarf; and a scarf holder engaged with a portion of said scarf such that said scarf is maintained at a substantially stable position, said scarf holder including a curvilinear body having a first end and a second end, a first fastener attached to said first end, and a second fastener attached to said second end;

wherein said first fastener is detachably mated to said second fastener such that said body is selectively adapted between an open position and a closed position;

wherein said body comprises: a plurality of arcuate members configured in a stacked orientation;

wherein each of said arcuate members is substantially coextensively shaped relative to each other;

wherein each of said arcuate members includes at least one longitudinal edge directly mated to a conjoining one of said arcuate members.

2. The combined scarf and scarf holder of claim 1, wherein each of said arcuate members has an identical radius of curvature such that said arcuate members are uniformly and contemporaneously flexed between equilibrium and tensioned positions, respectively.

3. The combined scarf and scarf holder of claim 2, wherein each of said arcuate members has a fixed and substantially coextensive longitudinal length relative to each other.

4. The combined scarf and scarf holder of claim 3, wherein said first fastener is coextensively shaped as said second fastener.

5. The combined scarf and scarf holder of claim 4, wherein said first fastener is directly coupled to said second fastener when said body is at said closed position.

6. The combined scarf and scarf holder of claim 5, wherein said first fastener comprises: a magnet situated therein.

7. The combined scarf and scarf holder of claim 6, wherein each of said arcuate members consists of: leather.

8. The combined scarf and scarf holder of claim 6, wherein each of said arcuate members consists of: mesh metal.

9. A combined scarf and scarf holder for keeping said scarf in place around a user neck, said combined scarf and scarf holder comprising:

a flexible scarf; and a scarf holder removably engaged with a portion of said scarf such that said scarf is maintained at a substantially stable position, said scarf holder including a curvilinear body having a first end and a second end, a first fastener attached to said first end, and a second fastener attached to said second end;

wherein said first fastener is detachably mated to said second fastener such that said body is selectively adapted between an open position and a closed position;

wherein said scarf is removably positioned through said scarf holder;

wherein said body comprises: a plurality of arcuate members configured in a stacked orientation;

wherein each of said arcuate members is substantially coextensively shaped relative to each other;

wherein each of said arcuate members includes at least one longitudinal edge directly mated to a conjoining one of said arcuate members.

10. The combined scarf and scarf holder of claim 9, wherein each of said arcuate members has an identical radius of curvature such that said arcuate members are uniformly and contemporaneously flexed between equilibrium and tensioned positions, respectively.

11. The combined scarf and scarf holder of claim 10, wherein each of said arcuate members has a fixed and substantially coextensive longitudinal length relative to each other.

12. The combined scarf and scarf holder of claim 11, wherein said first fastener is coextensively shaped as said second fastener.

13. The combined scarf and scarf holder of claim 12, wherein said first fastener is directly coupled to said second fastener when said body is at said closed position.

14. The combined scarf and scarf holder of claim 13, wherein said first fastener comprises: a magnet situated therein.

15. The combined scarf and scarf holder of claim 14, wherein each of said arcuate members consists of: leather.

16. The combined scarf and scarf holder of claim 14, wherein each of said arcuate members consists of: mesh metal.

17. A method of utilizing a combined scarf and scarf holder for keeping said scarf in place around a user neck, said method comprising the steps of:

providing a flexible scarf;

providing a scarf holder including a curvilinear body having a first end and a second end, a first fastener attached to said first end, and a second fastener attached to said second end;

removably engaging said scarf holder with a portion of said scarf, by removably positioning said scarf through said scarf holder, such that said scarf is maintained at a substantially stable position while positioned through said scarf holder; and selectively adapting said body between an open position and a closed position by detachably mating said first fastener to said second fastener;

wherein said body comprises: a plurality of arcuate members configured in a stacked orientation;

wherein each of said arcuate members is substantially coextensively shaped relative to each other;

wherein each of said arcuate members includes at least one longitudinal edge directly mated to a conjoining one of said arcuate members.

* * * * *